US008681088B2

(12) United States Patent
Park

(10) Patent No.: US 8,681,088 B2
(45) Date of Patent: Mar. 25, 2014

(54) LIGHT SOURCE MODULE, METHOD FOR DRIVING THE LIGHT SOURCE MODULE, DISPLAY DEVICE HAVING THE LIGHT SOURCE MODULE

(71) Applicant: Samsung Display Co., Ltd., Gyeonggi-do (KR)

(72) Inventor: Mun-Soo Park, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 0 days.

(21) Appl. No.: 13/875,991

(22) Filed: May 2, 2013

(65) Prior Publication Data

US 2013/0257922 A1 Oct. 3, 2013

Related U.S. Application Data

(63) Continuation of application No. 12/194,681, filed on Aug. 20, 2008, now abandoned.

(30) Foreign Application Priority Data

Dec. 4, 2007 (KR) ..... 10-2007-0124883

(51) Int. Cl.
*G09G 3/36* (2006.01)
*G09G 5/10* (2006.01)

(52) U.S. Cl.
USPC ..... 345/102; 345/89; 345/690

(58) Field of Classification Search
USPC ..... 345/87, 102, 204, 690
See application file for complete search history.

(56) References Cited

U.S. PATENT DOCUMENTS

2003/0146919 A1* 8/2003 Kawashima et al. ..... 345/609
2004/0257318 A1* 12/2004 Itoh ..... 345/87
2005/0057486 A1* 3/2005 Aoki et al. ..... 345/102

(Continued)

FOREIGN PATENT DOCUMENTS

| | | |
|---|---|---|
| JP | 2002-099250 | 5/2002 |
| JP | 2004-110050 | 4/2004 |
| JP | 2005-241678 | 9/2005 |
| JP | 2007-183499 | 7/2007 |

OTHER PUBLICATIONS

Notice of Allowance issued by the Korean Intellectual Patent Office dated Jul. 25, 2013 in corresponding Korean Appln. No. 10-2007-0124883.

*Primary Examiner* — Samati Lefkowitz
*Assistant Examiner* — David Tung
(74) *Attorney, Agent, or Firm* — F. Chau & Associates, LLC

(57) ABSTRACT

A light source module having a plurality of light source blocks corresponding to a plurality of display regions, a method for driving the light source module, and a display device having the light source module. The output brightness of each of the light source blocks is individually dimmed according to a dimming control signal. A dimming control unit determines the average gray level and inherent brightness of each of the respective display regions, calculates a threshold gray level of each display region by using its inherent brightness, outputs a fixed brightness as a dimming control signal when the average gray level of the display region is greater than the threshold gray level, and outputs a variable brightness based upon the inherent brightness value, as the dimming control signal when the average gray level of the display region is less than the threshold gray level.

24 Claims, 10 Drawing Sheets

(56) References Cited

U.S. PATENT DOCUMENTS

2006/0221260 A1* 10/2006 Fujine et al. ..... 348/790
2006/0238487 A1* 10/2006 Shih ..... 345/102
2006/0279565 A1* 12/2006 Wei et al. ..... 345/212
2007/0097069 A1* 5/2007 Kurokawa et al. ..... 345/102
2007/0200950 A1* 8/2007 Bae ..... 348/452
2008/0117160 A1* 5/2008 Oka et al. ..... 345/102

* cited by examiner

FIG. 4

| | | | | |
|---|---|---|---|---|
| 0.00 | 0.00 | 0.05 | 0.00 | 0.00 |
| 0.00 | 0.10 | 0.15 | 0.10 | 0.00 |
| 0.10 | 0.30 | 1.00 | 0.30 | 0.10 |
| 0.00 | 0.10 | 0.15 | 0.10 | 0.00 |
| 0.00 | 0.00 | 0.05 | 0.00 | 0.00 |

FIG. 5

| | | | | |
|---|---|---|---|---|
| 30 | 30 | 30 | 30 | 30 |
| 30 | 30 | 30 | 30 | 30 |
| 30 | 30 | X | 30 | 30 |
| 30 | 30 | 30 | 30 | 30 |
| 30 | 30 | 30 | 30 | 30 |

FIG. 6

| | | | | |
|---|---|---|---|---|
| 0.00 | 0.00 | 0.05 | 0.00 | 0.00 |
| 0.00 | 0.07 | 0.10 | 0.07 | 0.00 |
| 0.05 | 0.10 | 0.40 | 0.10 | 0.05 |
| 0.00 | 0.07 | 0.10 | 0.07 | 0.00 |
| 0.00 | 0.00 | 0.05 | 0.00 | 0.00 |

FIG. 7

| | | | | |
|---|---|---|---|---|
| 0.00 | 0.10 | 0.15 | 0.10 | 0.00 |
| 0.10 | 0.30 | 1.00 | 0.30 | 0.10 |
| 0.00 | 0.10 | 0.15 | 0.10 | 0.00 |

FIG. 11

| GRAY SCALE | BRIGHTNESS |
|---|---|
| 0 ~ 30 | 0 |
| 31 ~ 62 | 14 |
| 63 ~ 94 | 28 |
| 95 ~ 126 | 42 |
| 127 ~ 158 | 56 |
| 159 ~ 190 | 70 |
| 190 ~ 222 | 84 |
| 223 ~ 255 | 100 |

FIG. 12

| GRAY SCALE | BRIGHTNESS |
|---|---|
| 0 ~ 14 | 0 |
| 15 ~ 30 | 7 |
| 31 ~ 46 | 14 |
| 47 ~ 62 | 21 |
| 63 ~ 79 | 28 |
| 80 ~ 94 | 35 |
| 95 ~ 110 | 42 |
| 111 ~ 125 | 50 |

LIGHT SOURCE MODULE, METHOD FOR DRIVING THE LIGHT SOURCE MODULE, DISPLAY DEVICE HAVING THE LIGHT SOURCE MODULE

CROSS-REFERENCE TO RELATED APPLICATION

This application is a Continuation of U.S. application Ser. No. 12/194,681 filed on Aug. 20, 2008, which claims priority to Korean Patent Application No. 10-2007-0124883 filed on Dec. 4, 2007, which is incorporated by reference in its entirety.

BACKGROUND OF THE INVENTION

1. Field of the Invention

The present invention relates to a light source module, a method for driving the light source module, and a display device having the light source module, and more particularly, to a light source module divided into several regions for a display device, wherein brightness dimming is performed on each light source block depending upon the brightness of adjacent light source blocks.

2. Description of the Related Art

Generally, liquid crystal displays (LCDs), a type off flat display panels, contain liquid crystal pixels that are not self-luminous. Therefore a separate light source module (e.g., backlight unit) is one of the key components of a liquid crystal display (LCD). LCDs display an image by filtering light emitted from a separate light source module (e.g., a backlight). The light source module includes a light source and a light source driver driving the light source.

Conventionally, a light source module provides light with uniform brightness over the entire surface of the flat display panel. This generally degrades the contrast ratio of the display panel. When the display panel displays an all-black image, the light source module still generates light with uniform brightness and there is typically some light leakage through or around the pixels of the display panel. Furthermore, the light source module typically consumes the most power of all the components of the display.

Therefore, efforts have been made to divide the total screen area of the display panel into a plurality of regions (blocks) having the same size, and providing a plurality of brightness control (i.e., a brightness dimming) circuits to independently control the brightness in each region. To this end, the light source module includes a plurality of light source blocks corresponding to the respective display regions. In this way, light leakage of the display panel is reduced and the power consumption is reduced. To independently perform the brightness dimming on each region, the brightness value of each region is independently calculated using an average gray level value (average gray level) of an image signal provided to each region. The independently calculated brightness value of each region is used for independently dimming the brightness of the light which the light source module provides to each region. Since the respective regions independently receive light with the corresponding brightness, a significant brightness difference exists along linear (e.g., top, bottom, right side, and left side) boundaries of the regions. Such a brightness difference can cause brightness spots. The brightness spots degrade the image displayed by the LCD.

SUMMARY OF THE INVENTION

The present disclosure provides a light source module, a method for driving the light source module, and a display device having the light source module. The light source module performs brightness dimming on each light source block and controls the brightness dimming of each light source block with consideration of interference brightness caused by adjacent light source blocks, thereby reducing brightness spots and maximizing a relative contrast ratio locally.

An aspect of the invention provides a light source module comprising: a light source assembly including a plurality of light source blocks corresponding to a plurality of display regions and configured to dim the output brightness of each of the light source blocks according to a dimming control signal; and a dimming control unit configured to determine average gray level and inherent brightness of the respective display region, to calculate a threshold gray level of each display region by using the inherent brightness, to section the gray levels into a first gray level section and a second gray level section on the basis of the threshold gray level, and for each light source block, to output a fixed brightness as a dimming control signal when the average gray level of the display region is within the first gray level section, or to output a variable brightness based upon the inherent brightness value, as the dimming control signal when the average gray level of the display region is within the second gray level section.

The fixed brightness may be the maximum brightness of the light source block, and the variable brightness may be selected within a range of brightness less than the maximum brightness.

The dimming control signal may be output as the maximum brightness when the average gray level is equal to the threshold gray level.

The gray levels of the first gray level section may be greater than the threshold gray level value, while the gray levels of the second gray level section may be less than the threshold gray level value.

The dimming control unit may include: an inherent brightness signal generator configured to generate the average gray levels and the inherent brightness of the display regions by using image signals applied to the display regions; an interference brightness signal generator configured to generate an interference brightness value of each display region by using the inherent brightness of the adjacent display regions and a point spread function (PSF) filter; a threshold gray level determiner configured to determine the threshold gray level by using the interference brightness value; and a dimming control signal generator configured to output one of the maximum brightness value and a brightness value less than the maximum brightness value as the dimming control signal according to the threshold gray level and the average gray level.

The threshold gray level may correspond to a brightness value that becomes a maximum brightness value when added to the interference brightness value.

The inherent brightness signal generator may include: an average gray level calculator configured to calculate the average gray level of each light source block by using the image signals; and an inherent brightness extractor configured to extract a brightness value corresponding to the average gray level as the inherent brightness value.

The inherent brightness extractor may include a uniform lookup table configured to store a plurality of uniform gray level groups each uniform gray level group including at least one gray level, and a plurality of brightness values corresponding to the respective uniform gray level groups.

The light source module may further include an inherent brightness adjuster including a variable lookup table configured to store a plurality of variable brightness values corresponding to a plurality of variable gray level groups each variable gray level group including at least one of the gray levels less than the threshold gray level, and configured to extract brightness values corresponding to the average gray level as a varied inherent brightness value by using the variable lookup table. The number of the gray levels within each variable gray level group may be less than the number of the gray level groups within each uniform gray level group.

The maximum variable brightness value of the variable lookup table may be an interference brightness value.

The dimming control signal generator may output as the dimming control signal a brightness value corresponding to the sum of the varied brightness value and the interference brightness value when the average gray level is less than the threshold gray level, and may output the maximum brightness value as the dimming control signal when the average gray level is greater than or equal to the threshold gray level.

The PSF filter may have a matrix form with a plurality of weight values, in which a center value of the matrix is in the range of 0.1 to 1 and values around the center of the matrix decrease in the form of a Gaussian function.

The center of the PSF filter may be arranged to correspond to the center display region, and the interference brightness value may be obtained by multiplying weight values, except for the center value of the matrix, by the corresponding inherent brightness values of the adjacent display regions and summing the multiplication results.

The dimming control signal generator may output a brightness value corresponding to the sum of the inherent brightness value and the interference brightness value as the dimming control signal when the average gray level is less than the threshold gray level, and may output the maximum brightness value as the dimming control signal when the average gray level is less than the threshold gray level.

The light source module may further include an interference gray level extractor configured to generate an interference gray level by using the interference brightness value.

The dimming control signal generator may be configured to output the maximum brightness value as the dimming control signal when the average gray level is greater than or equal to the threshold gray level, output a brightness value corresponding to a sum of the inherent brightness value and the interference brightness value as the dimming control signal when the average gray level is less than the threshold gray level and greater than or equal to the interference gray level, and output one of the inherent brightness value or a minimum brightness value as the dimming control signal when the average gray level is less than the interference gray level.

Another aspect of the invention provides a method for driving a light source module comprising: calculating each average gray level of each of a plurality of display regions corresponding to a plurality of light source blocks by using image signals applied to the display regions; calculating the inherent brightness of each of the display regions by using its average gray level; determining a threshold gray level according to the inherent brightness of a predetermined display region and of display regions adjacent to the predetermined display region; and sectioning total gray levels into a first gray level section and a second gray level section on the basis of the threshold gray level, and enabling the light source block corresponding to the predetermined display region to emit light having a brightness based upon the inherent brightness when (if) the average gray level is located within the first gray level section, or enabling the light guide block to emit light with maximum brightness when (if) the average gray level is located within the second gray level section.

The determining of the threshold gray level may include: calculating the interference brightness of the predetermined display region by using the inherent brightness of the adjacent display regions and a PSF filter; and determining, as the threshold gray level, the gray level corresponding to the brightness value that becomes a maximum brightness value when added to the interference brightness value.

The brightness based upon the inherent brightness may be obtained by summing the interference brightness and the inherent brightness.

The method may further include generating an interference gray level by using the interference brightness value, after the determining of the threshold gray level. The light emitting of the light source block may include: enabling the light source block to emit light having the inherent brightness or the minimum brightness when (if) the average gray level is within the first gray level section and is less than the interference gray level; or enabling the light source block to emit light having the brightness based upon the inherent brightness when (if) the average gray level is greater than the interference gray level and less than the threshold gray level.

The method may further include extracting a brightness value corresponding to the average gray level as the varied brightness value by using a variable lookup table, the variable lookup table being configured to store a plurality of variable gray level groups each variable gray level group including gray levels less than the threshold gray level, and a plurality of variable brightness values corresponding to the respective variable gray level groups, wherein the inherent brightness is calculated by using a uniform lookup table, the uniform lookup table being configured to store a plurality of uniform gray level groups each uniform gray level group including at least one gray level, and a plurality of brightness values corresponding to the respective uniform gray level groups, the number of the gray levels within each of the variable gray level groups being less than the number of the gray levels within each of the uniform gray level groups.

The brightness based upon the inherent brightness may be obtained by summing the interference brightness and the inherent brightness.

Another aspect of the invention provides, a display device comprising: a display panel having an image display panel, the image display panel being divided into a plurality N (an integer number) of display regions; a light source assembly including a plurality N of light source blocks corresponding to the N display regions and configured to dim the output brightness of each of the light source blocks according to N dimming control signals; and a dimming control unit configured to determine average gray level of each light source block and the inherent brightness of each respective display region, to calculate a threshold gray level of each display region by using the inherent brightness, to section the gray levels into a first gray level section and a second gray level section on the basis of the threshold gray level, and for each light source block, to output a fixed brightness as its dimming control signal when an average gray level of the display region is within the first gray level section, or to output a variable brightness, which varies depending upon the inherent brightness value, as its dimming control signal when the average gray level of the display region is within the second gray level section.

The dimming control unit may be manufactured as an integrated circuit (IC) chip.

BRIEF DESCRIPTION OF THE DRAWINGS

Features of the invention can be understood in more detail from the following description taken in conjunction with the accompanying drawings of exemplary embodiments, in which same reference numerals in the figures denote the same elements, and:

FIG. 4 is a diagram of display regions of a panel illustrating a point spread function (PSF) filter in accordance with an exemplary embodiment;

FIG. 5 is a diagram of display regions of a panel illustrating examples of inherent brightness values in respective display regions in accordance with an exemplary embodiment;

FIGS. 6 and 7 are diagrams of display regions of a panel illustrating a modifications of the PSF filter of FIG. 1;

FIG. 11 illustrates a uniform lookup table in accordance with another exemplary embodiment;

FIG. 12 illustrates a variable lookup table in accordance with another exemplary embodiment;

DETAILED DESCRIPTION OF EXEMPLARY EMBODIMENTS OF THE INVENTION

Figure 1:
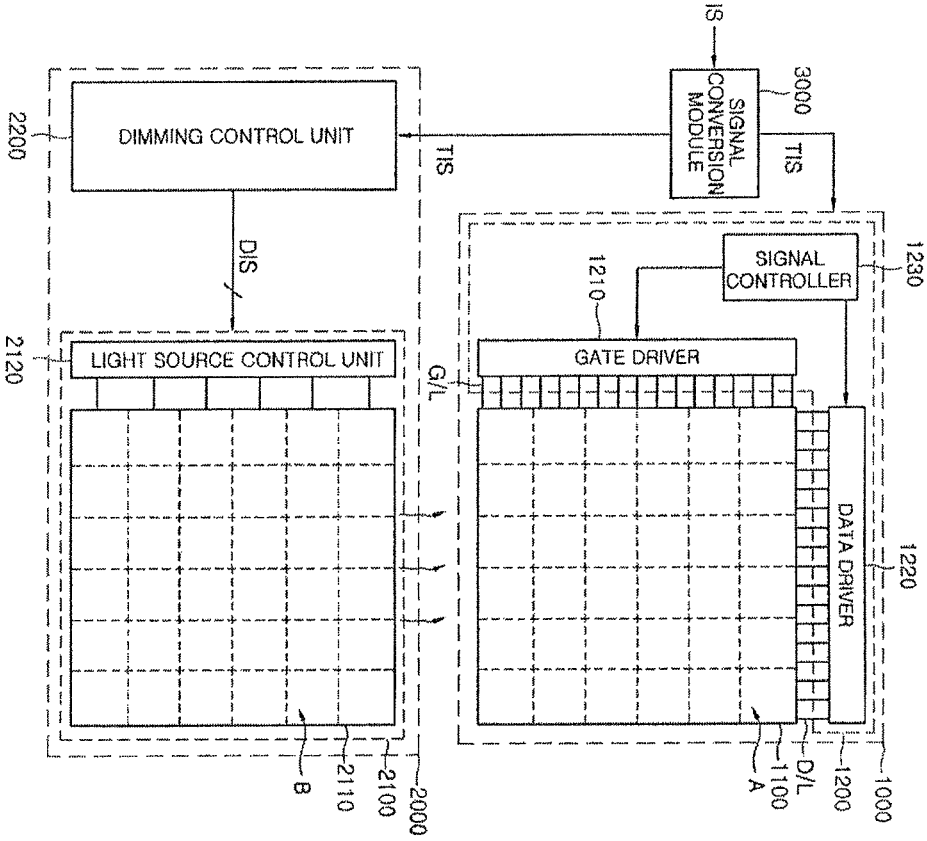
FIG. 1 is a block diagram of a display device in accordance with an exemplary embodiment of the invention.
Figure 2:
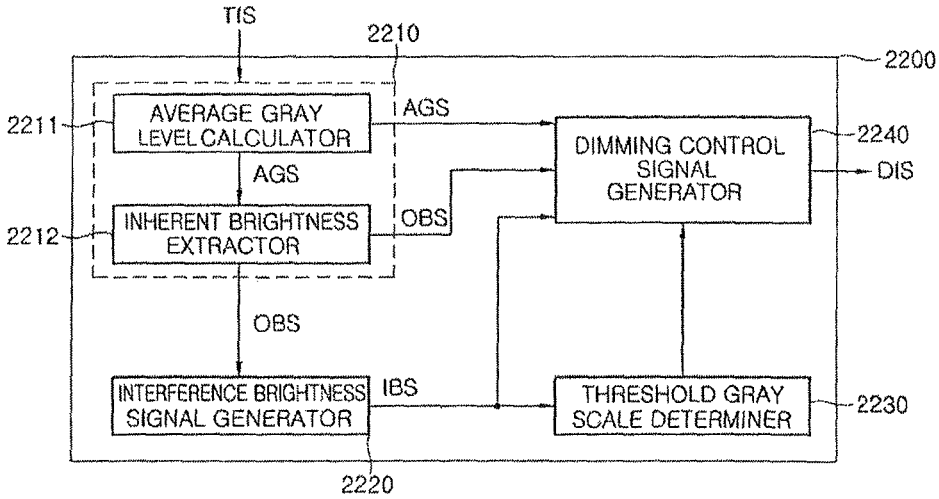
FIG. 2 is a block diagram of a dimming controller 2200 shown in the display device of FIG. 1.
Figure 3:
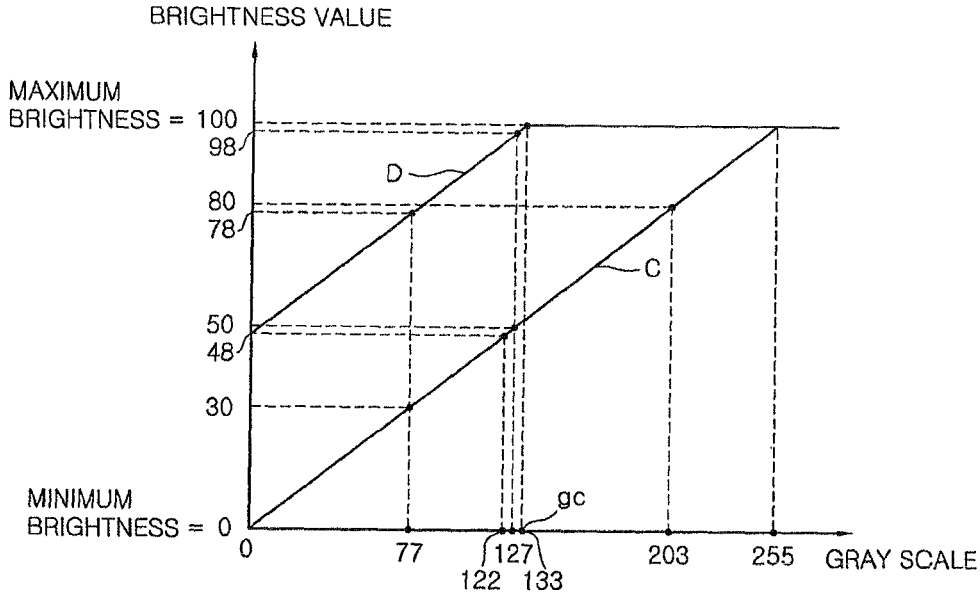
FIG. 3 is a graph comparing brightness of a backlight block with gray levels of an image signal of the block in the display device of FIG. 1.

FIG. 1 is a block diagram of a display device in accordance with an exemplary embodiment. FIG. 2 is a block diagram of the dimming controller 2200 show in the display device of FIG. 1. FIG. 3 is a graph comparing brightness of a backlight block with gray levels of an image signal of the block in the display device of FIG. 1.

Referring to FIGS. 1 through 3, the display device in accordance with an exemplary embodiment includes a display panel 1000, a light source module 2000, and a signal conversion module 3000.

The signal conversion module 3000 converts an image signal IS input received from an external video card (not shown) and provides the converted image signal TIS, to the display panel 100 and to the light source module 2000. In this exemplary embodiment, the signal conversion module 3000 converts an image signal IS having a transition minimized differential signaling (TMDS) format into an converted image signal TIS having a low voltage differential signaling (LVDS) format. The signal conversion module 3000 may be formed integrally upon the display panel 1000 or on the light source module 2000.

As illustrated in FIG. 1, the display panel 1000 includes a liquid crystal display (LCD) panel 1100 for displaying an image, and a panel control unit 1200 controlling the LCD panel 1100.

The LCD panel 1100 is divided into a plurality of display regions A. Each of the display regions A includes a plurality of pixels (not shown in detail). It is preferable that the display regions A of the LCD panel 1100 are arranged in a matrix form, as illustrated in FIG. 1.

Although not shown in detail in the figures, each of the pixels of the LCD panel 1100 may include a thin film transistor (TFT) and a liquid crystal capacitor. Each pixel may further include a storage capacitor. A drain of the TFT is connected to the liquid crystal capacitor. The liquid crystal capacitor includes a lower pixel electrode, an upper common electrode, and a layer of liquid crystal molecules between the pixel electrode and the common electrode. A color filter is provided above the liquid crystal capacitor. Each of the pixel electrode and the common electrode may be divided into a plurality of sub-pixel domains. The LCD panel 1100 is not limited to this exemplary embodiment, and may be modified in various ways. Thus, a plurality of sub-pixels may be provided within each pixel. Furthermore, each pixel may be longer in a transverse direction than in a longitudinal direction, or vice versa. Moreover, the pixel may be modified into a variety of shapes other than a rectangle. The LCD panel 1100 has a plurality of gate lines G/L and a plurality of data lines D/L. The TFT of each pixel has a gate connected to one of the gate lines G/L, and a source connected to one of the data lines D/L. The TFT is turned ON in response to a signal applied to the gate line G/L, and an image signal applied to the data line D/L is provided to the liquid crystal capacitor. The LCD panel 1100 includes a bottom substrate, on which the TFTs and the pixel electrodes are formed, and a top substrate, on which the common electrodes and the color filters are formed. Also, the LCD panel 1100 includes the layer of liquid crystal molecules between the bottom substrate and the top substrate.

The panel control unit 1200 includes a gate driver 1210, a data driver 1220, and a signal controller 1230. The gate driver 1210 sequentially applies gate turn-ON signals to the gate lines G/L in response to control signals output from the signal controller 1230. The data driver 1220 applies the image signals to the data lines D/L. The signal controller 1230 generates a plurality of control signals to control the gate driver 1210 and the data driver 1220. The signal controller 1230 applies the converted image signal TIS, which is output from the signal conversion module 3000, as the image signal IS to the data driver 1220. A timing controller may be used as the signal controller 1230. Although not shown in the figures, the panel control unit 1200 may further include a voltage generator that generates voltages to be applied to the gate driver 1210 and the data driver 1220. Additionally, the panel control unit 1200 may further include a clock controller that controls the clock cycles of a gate signal. The panel controller 1200 may further include a variety of other circuit elements known to persons skilled in the art, for controlling the operation of the LCD panel 1100.

In this exemplary embodiment, the respective elements 1220, 1210, and 1230 of the panel controller 1200 may be manufactured as a plurality of IC chips and mounted on a printed circuit board (PCB). The PCB may be connected to the LCD panel 1100 through a flexible printed circuit board (FPCB). The present invention is not limited to this exemplary embodiment. A portion of elements 1220, 1210, and 1230 of the panel control unit 1200 may be mounted on the bottom substrate of the LCD panel 1100. Furthermore, the gate driver 1210 may be manufactured on the bottom substrate of the LCD panel 1100. Thus, the gate driver 1210 may be manufactured together with the TFTs of the LCD panel 1100.

The light source module 2000 includes a light source assembly 2100 and a dimming control unit 2200.

The light source assembly 2100 includes a plurality of light source blocks B that correspond to (e.g., underlap) the display regions A of the LCD panel 1100, and a light source control unit 2120 for changing voltages to be applied to the light source blocks B according to a plurality of dimming control signals output from the dimming control unit 2200.

The light source blocks B are arranged in a matrix form. The light source blocks B correspond to (e.g., underlap) the display regions A of the LCD panel 1100. Thus, one light source block B emits light to one display region A of the LCD panel 1100. The light source blocks B each emit light according to the voltages applied from the light source control unit 2120. Each light source block B output light having a brightness corresponding to the brightness of images to be displayed in the corresponding display region A of the LCD panel 1100, according to the dimming control signals DIS output from the dimming control unit 2200. Therefore, the light source module in accordance with this exemplary embodiment can perform a local dimming.

The respective light source blocks B may use different light emitting devices of various technologies. For example, the light emitting devices may be selected from the group consisting of cold cathode fluorescent lamp (CCFL), external electrode fluorescent lamp (EEFL), light emitting diode (LED), organic light emitting diode (OLED), and various fluorescent discharge lamps. Preferably, the light source blocks B in accordance with this exemplary embodiment are implemented with a plurality of LEDs. In the case of LEDs, the light source blocks B includes a plurality of LEDs and a substrate in which the plurality of LEDs are mounted.

The light source control unit 2120 can adjust the brightness of the light source blocks B by controlling the pulse width of a pulsed voltage applied to each of the light source blocks B. Although not shown, the light source control unit 2120 includes a light source driver connected to the light source blocks B to apply pulsed voltages to the light source blocks, and a pulse width controller configured to control pulse widths of the pulsed voltages according to the dimming control signals DIS output from the dimming control unit 2200. The light source driver may include a DC-DC converter. However, the present invention is not limited to the DC-DC converter. The light source driver may use various types of converters or inverters according to the technologies of the light source blocks B. The pulsed voltage is typically a square pulse. The pulse width controller controls the duty rate of the square pulse sent to each of the light source blocks B. In this way, brightness of each light source block B is individually controlled. In alternative embodiments, the brightness of each light source blocks B can also be controlled by adjusting the pulse width of a pulsed current, or the amplitude of a voltage or current.

Furthermore, although not shown, the light source assembly 2100 may include at least one photo sensor. The photo sensor senses the luminous intensity of the light source assembly 2100. The photo sensor can provide the sensed luminous intensity of the light source assembly 2100 to the dimming control unit 2200 for controlling the total brightness of the light source assembly 2100.

The dimming control unit 2200 generates a plurality of dimming control signals DIS for controlling the amount of light emission (i.e., output brightness) of the light source blocks B according to the converted image signal TIS output from the signal conversion module 3000.

The dimming control unit 2200 provides the plurality of dimming control signals DIS to the light source control unit 2120. The dimming control unit 2120 in accordance with this exemplary embodiment calculates an inherent brightness of a corresponding display region A (e.g., using the average gray level of the portion of the converted image signal TIS provided to each region A) and calculates an interference brightness due to adjacent display regions A adjacent to the corresponding display region A, and determines a threshold gray level according to the interference brightness. The dimming control unit 2200 outputs a maximum brightness as a dimming control signal when a average gray level corresponding to the inherent brightness is equal to or higher than the threshold gray level, and outputs a sum of the inherent brightness and the interference brightness as the dimming control signal DIS when the average gray level corresponding to the inherent brightness is lower than the threshold gray level.

Referring to FIG. 2, the dimming control unit 2200 includes an inherent brightness signal generator 2210, an interference brightness signal generator 2220, a threshold gray level determiner 2230, and a dimming control signal generator 2240.

The inherent brightness signal generator 2210 calculates the inherent brightness values based on the portion of converted image signals TIS applied to each display region A corresponding to the light source blocks B. The inherent brightness signal generator 2210 includes an average gray level calculator 2211 configured to calculate the average gray level of the converted image signals TIS applied to each display region A, and an inherent brightness extractor 2212 configured to extract an inherent brightness value corresponding to the average gray level.

The average gray level calculator 2211 calculates the average gray level value (average gray level) by summing the gray levels of the image signals TIS applied to each display region A and dividing the sum of the gray levels by the number of the image signals TIS applied to each display region A. The inherent brightness extractor 2212 extracts the inherent brightness value according to the average gray level value (average gray level). The inherent brightness extractor 2212 determines the inherent brightness corresponding to the average gray level value (average gray level), which is calculated based on a line C of FIG. 3, as the inherent brightness value. Preferably, the average gray level is one of 256 gray levels (e.g., from 0 to 255) as illustrated in FIG. 3. Preferably, the brightness is in the range of 0 to 100. In alternative embodiments, the brightness is in the range of 0 to 122. The brightness represents brightness of the light source block corresponding to the gray level.

The gray level and the brightness described above can be in linear proportion as indicated by the line C of FIG. 3. This is because the transmittance of the liquid crystal increases substantially linearly according to the gray level. Thus, the brightness can be calculated by multiplying the gray level by a predetermined slope value. In other words, the inherent brightness extractor 2212 can calculate the inherent brightness value by using a linear function in which a dependent variable is calculated by multiplying an independent variable by a fixed value (or by adding an independent variable to a fixed value). In this exemplary embodiment, each one gray level increment corresponds to one brightness. Therefore, as illustrated in FIG. 3, the gray level and the brightness can be linearly changed in a straight form due to the linear function. The present invention is not limited to having this linear function. The inherent brightness extractor 2212 can extract the inherent brightness value by using a variety of functions, such as a quadratic function, a fractional function, a trigonometric function, an exponential function, or a logarithmic function. Thus, the gray level and the brightness may be linearly changed in a curved form. The gray level and the brightness may be changed in a shape in which a portion of a curve is approximately a straight line.

Preferably, the inherent brightness extractor 2212 in accordance with this exemplary embodiment stores the independent variable (i.e., the gray level) and the corresponding dependent variable (i.e., the brightness) in a memory in a lookup table. When the average gray level is input to the inherent brightness extractor 2212, the inherent brightness extractor 2212 extracts brightness corresponding to the average gray level from the lookup table and outputs the extracted brightness as the inherent brightness.

As illustrated in FIG. 3, the gray level of 0 corresponds to the minimum brightness of 0. This means that a black data is applied as the image signal. In this case, it is preferable that the light source block B does not emit any light. The gray level of 255 corresponds to the maximum brightness of 100. This means that a white data is applied as the image signal. In this case, it is preferable that the light source block B emits light with the maximum amount of light emission.

In this exemplary embodiment, the inherent brightness extractor 2212 extracts the output brightness corresponding to the average gray level as the inherent brightness. For example, when the average gray level value (average gray level) is 77, a value of 30 is output as the inherent brightness. When the average gray level value (average gray level) is 127, a value of 50 is output as the inherent brightness. When the average gray level value (average gray level) is 203, a value of 80 is output as the inherent brightness.

The present invention is not limited to the above example. In alternative embodiments, the gray level can be inversely proportional to the output brightness. This is because in such alternative embodiments the transmittance of the liquid crystal can be linearly reduced according to the gray level because of the features of the liquid crystal. Thus, the gray level of 0 and the gray level of 255 may be the maximum brightness and the minimum brightness, respectively.

The inherent brightness signal generator 2210 outputs an average gray level signal AGS corresponding to the calculated average gray level, and an inherent brightness signal OBS corresponding to the inherent brightness value. In the above-described exemplary embodiment, the output brightness and the inherent brightness value are expressed by numbers (e.g., binary numbers). For convenience of explanation the output brightness and the inherent brightness value are expressed by a percentage of a maximum (rated) voltage or current of an electric signal. Therefore, the range of the output brightness is not limited to the above-described range, but it can be expressed as various ranges. In this exemplary embodiment, the inherent brightness value is identical to the inherent brightness signal.

The interference brightness signal generator 2220 generates the interference brightness values caused by (based on) the adjacent display regions A by using the respective inherent brightness values of the display regions A and a point spread function (PSF) filter. The PSF filter is a filter that artificially generates a virtual interference brightness. Brightness spots can be reduced by artificially generating the virtual interference brightness and applying the interference brightness to the light source block.

In the case where the local dimming is not performed, all the light source blocks B emit light with the maximum brightness. Thus, the brightness of light emitted to each corresponding display region A is a sum of the brightness of the corresponding light source block B and the interference brightness caused by the adjacent light source blocks B. However, in the case where the local dimming is performed in accordance with this exemplary embodiment, brightness spots can occur at boundaries between the adjacent display regions if the interference brightness caused by the adjacent light source blocks B is not considered. Therefore, in this exemplary embodiment, the brightness of each display region A is readjusted, with considering for the interference brightness.

To this end, the interference brightness signal generator 2220 generates the interference brightness value by using the PSF filter and the inherent brightness signal OBS from the inherent brightness signal generator 2210.

FIG. 4 is a diagram of display regions of a panel illustrating a PSF filter in accordance with an exemplary embodiment, and FIG. 5 is a diagram of display regions of the panel illustrating examples of inherent brightness values in the respective display regions of the panel. As illustrated in FIG. 4, the PSF filter may be manufactured in a 5×5 matrix form in which a center value is 1 and adjacent values are reduced in a form of a Gaussian function. It is preferable that the adjacent values are adjusted, with considering for the light emission distribution of the light source (i.e., LED). In FIG. 5, the interference brightness in a center region X is 48 when the inherent brightness in all the adjacent display regions A is 30. Thus, the PSF filter is adjusted such that its center is matched with the display region for calculating the interference brightness. A weight value in the PSF filter is multiplied by the inherent brightness of the display region A corresponding to the weight value, and the resulting values are added. Thus, when the center region X of FIG. 5 is matched with 1.00 of FIG. 4, the interference brightness value is calculated as follows:

Interference brightness value of display center region $$X=30*0.00+30*0.00+30*0.05+30*0.00+30*0.00+30*0.00+30*0.10+30*0.15+30*0.10+30*0.00+30*0.10+30*0.30+30*0.30+30*0.10+30*0.00+30*0.10+30*0.15+30*0.10+30*0.00+30*0.00+30*0.00+30*0.50+30*0.00+30*0.00=30*0.05*2+30*0.10*6+30*0.15*2+30*0.3*2=48$$

is a diagram of display regions of the panel The interference brightness signal generator 2220 outputs the calculated interference brightness value as the interference brightness signal IBS. The interference brightness value is a value expressed as percentage of the voltage or current of an electric signal such as the inherent brightness value described above.

The above-described PSF filter can be modified in various ways.

FIGS. 6 and 7 are diagram of the display regions of the panel illustrating modifications of the PSF filter of FIG. 5.

As illustrated in FIG. 6, a center value is not limited to 1, but can be smaller than 1. A PSF filter with a center value of 0.4 is illustrated in FIG. 6. Preferably, the center value can be selected within the range of 0.1 to 1.0. The adjacent values are changed in conformity with a Gaussian function to the change of the center value. Furthermore, as shown in FIG. 7, the PSF filter may have a 3×5 matrix form. Rows and columns can be selected within the range of 3 to 7. The interference brightness value can vary according to the center value and matrix form of the PSF filter. Preferably, the PSF filter uses filter coefficients determined by simulation or measurement.

The threshold gray level determiner 2230 determines the threshold gray level by using the interference brightness signal IBS generated from the interference brightness signal generator 2220. The threshold gray level represents a gray level having a maximum brightness value when interference brightness values among the brightness values corresponding to the gray levels are added.

As described above with reference to FIG. 5, the case where the interference brightness value is 48 will be considered. As illustrated in FIG. 3, when the gray level of the corresponding display region is 77, the final brightness value of the corresponding display region is 78 (~30+48), which is a sum of the interference brightness value of 48 and the inherent brightness value of 30 corresponding to the gray level of 77. When the gray level of the corresponding display region is 127, the final brightness value is 98 (=50+48). When the gray level of the corresponding display region is 203, the final brightness value is 128 (=80+48). However, since the output brightness cannot exceed the maximum brightness value of 100, the final brightness value for the gray level of 128 is 100. Additionally, the final brightness value for the gray level of 133 is 100 (=52+48). Thus, the gray level of 133 is the threshold gray level. The threshold gray level value is the gray level value (e.g., gray level of 133) corresponding to the brightness value (e.g., 52) obtained by subtracting the interference brightness value (e.g., 48) from the maximum brightness value (e.g., 100). The threshold gray level value can be calculated by various methods. Thus, the threshold gray level value (i.e., 255−122=gray level of 133) can be calculated by subtracting the gray level value (i.e., the gray level of 122) corresponding to the interference brightness value (i.e., 48) from the maximum gray level value (i.e., the gray level of 255).

The dimming control signal generator 2240 generates the dimming control signals DIS for brightness dimming of the respective light source blocks by using the average gray level signal AGS and the inherent brightness signal OBS of the inherent brightness signal generator 2210, the interference brightness signal IBS of the interference brightness signal generator 2220, and the threshold gray level of the threshold gray level determiner 2230. Then, the dimming control signal generator 2240 provides the generated dimming control signals DIS to the light source assembly 2100. The total number of gray levels (from the gray level of 0 to the gray level of 255) is divided into a first gray level section and a second gray level section on the basis of the threshold gray level. In this exemplary embodiment, the first gray level section is a low gray level section containing gray levels lower than the threshold gray level, and the second gray level section is a high gray level section containing gray levels higher than the threshold gray level.

The dimming control signal generator 2240 determines if the average gray level value (average gray level) is greater than the threshold gray level value. When the dimming control signal generator 2240 determines that the average gray level value (average gray level) is located at the second (higher-than threshold) gray level section, the dimming control signal generator 2240 outputs the maximum brightness value (e.g., 100) as a dimming control signal DIS. Thus, when the average gray level value (average gray level) is equal to or greater than the threshold gray level, the dimming control signal generator 2240 outputs the maximum brightness value (e.g., 100) to the light source block B. When the dimming control signal generator 2240 determines that the average gray level value (average gray level) is located at the first (lower-than threshold) gray level section, the dimming control signal generator 2240 outputs the final brightness value corresponding to the sum of the inherent brightness signal OBS and the interference brightness signal IBS as the final brightness value.

Thus, as illustrated in FIG. 3, all the final brightness values at the gray levels (i.e., the second gray level section) higher than the threshold gray level (e.g., the gray level of 133) have the maximum output brightness value. The final brightness values at the gray levels (i.e., the first gray level section) lower than the threshold gray level (e.g., the gray level of 133) vary according to the inherent brightness value of the corresponding average gray level.

Therefore, when the average gray level of the display region A has the gray level within the second gray level section (i.e., the section between the threshold gray level and the maximum gray level of 255), the maximum output brightness becomes the final brightness value, regardless of the inherent brightness value of the display region A. In this case, the light source block B emits light with the highest brightness, without substantial brightness dimming. Furthermore, when the average gray level of the display region A has the gray level within the first gray level section (i.e., the section between the minimum gray level (i.e., the gray level of 0) and the threshold gray level), the sum of the inherent brightness value of the display region A and the interference brightness value becomes the final brightness value. When the average gray level has the gray level between the minimum gray level (e.g., 0) and the threshold gray level, the light source block B performs the brightness dimming Thus, the light source block B emits light with brightness corresponding to the final brightness value.

The dimming control signal generator 2240 determines whether to perform the brightness dimming of the light source block according to the determined threshold gray level or to make the light source block emit light with the maximum brightness. Then, the dimming control signal generator 2240 provides the dimming control signals DIS to the light source assembly 2100 according to the determination result.

In this exemplary embodiment, the threshold gray level value for brightness dimming varies according to the inherent brightness of the adjacent display regions A (i.e., interference brightness). Thus, as the inherent brightness values of the adjacent display regions A decrease, the threshold gray level is increased closer to the maximum gray level (e.g., 255). As the inherent brightness values of the adjacent display regions A increase, the threshold gray level is decreased closer to the minimum gray level (e.g., 255). This means that the number of the gray levels (the number of gray levels of the region between the minimum gray level and the threshold gray level) to be brightness dimmed is decreased as the interference brightness value is increased. Conversely, the number of the gray levels (the number of gray levels of the region between the minimum gray level and the threshold gray level) to be brightness dimmed is larger is increased as the interference brightness value is decreased.

For example, when the interference brightness value of a light source block B is increased to 80, the gray level of 53 becomes the threshold gray level. Therefore, the brightness dimming of each light source blocks B having interference brightness 80 is actually performed only between the gray level of 0 to the gray level of 52 among the gray levels of the corresponding display region A. The light source blocks between the gray level of 53 to the gray level of 255 always emit light with the maximum brightness 100. As another example, when the interference brightness value is 30, the threshold gray level becomes 179. Therefore, the brightness dimming is performed only between the gray level of 0 to the gray level of 179, and the light source blocks B having a gray level of between 179 to 255 have the maximum brightness.

When the interference brightness value is 80, the final brightness value is 80 even though the inherent brightness value of the corresponding display region A is not zero. Thus, when the brightness of the display regions A adjacent to the display region A corresponding to the light source block B are bright, the source block B can be made bright. This means that as the inherent brightness values of the adjacent display regions are larger, the light source block B corresponding to the display region A is closer to the maximum brightness. Furthermore, when the brightness of the display regions A adjacent to the display region A corresponding to the light source block B are dark, the interference brightness of the corresponding light source block B can be relatively dark.

The elements 2210, 2220, 2230, and 2240, of the dimming control unit 2200 may be manufactured in separate IC chips. The threshold gray level determiner 2230 and the dimming control signal generator 2240 can be integrated into a single output unit, instead of a separated chip configuration. Furthermore, the interference brightness signal generator 2220 and the threshold gray level determiner 2230 can be integrated into a single signal determining and generating unit, instead of the separated configuration shown. Although not shown, the dimming control unit 2200 in accordance with the exemplary embodiment may further include a memory. The memory can store all signals provided to the dimming control unit 2200, and all signals used in the dimming control unit 2200. Furthermore, the dimming control unit 2200 can be manufactured as an IC chip and mounted on a panel substrate on which circuit elements of the light source assembly 2100 are mounted. Moreover, the dimming control unit 2200 may be mounted on a substrate in which the panel control unit 1200 is mounted.

As described above, the threshold gray level can be set using the interference brightness. Thus, when the average gray level value (average gray level) of the display region A of the LCD panel 1100 is greater than or equal to the threshold gray level value, the maximum brightness value is output as the dimming control signal DIS, without separate dimming operation. When the average gray level value (average gray level) of the display region A is less than the threshold gray level value, the final brightness value obtained by summing the inherent brightness value and the interference brightness value is output as the dimming control signal DIS. In this way, brightness spots between the adjacent display regions A can be prevented, and a relatively sufficient contrast ratio can be ensured.

Although it has been described in the exemplary embodiment described above that the brightness value linearly increases as the average gray level value (average gray level) increases, the present invention is not limited thereto. As the average gray level increases, the brightness value may linearly decrease according to features of the liquid crystal within the LCD panel 1100. In this case, the maximum brightness and the minimum brightness described above can be changed. Thus, when the average gray level value (average gray level) is between the minimum gray level and the threshold gray level, the maximum output brightness value can be the final brightness value, regardless of the inherent brightness value of the display region A. Furthermore, when the average gray level value (average gray level) is between the threshold gray level and the maximum gray level, the sum of the inherent brightness value of the display region A and the interference brightness value can be the final brightness value. Thus, the first gray level section and the second gray level section described above can be interchanged.

The operation of the light source module in accordance with the exemplary embodiment will be described below.

Figure 8:
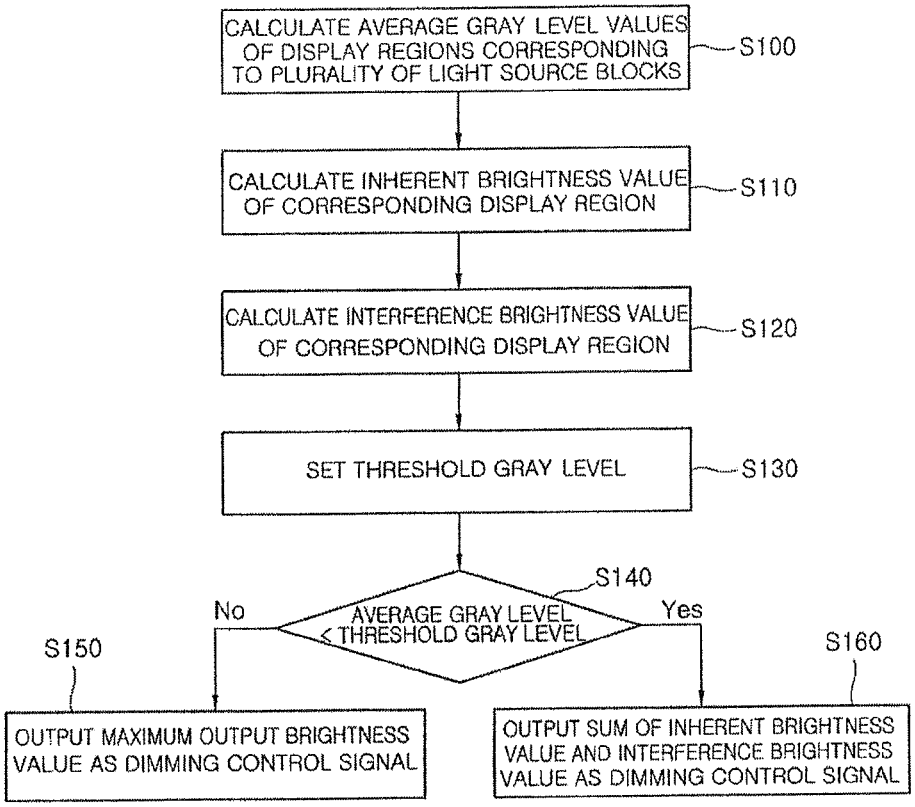
FIG. 8 is a flowchart illustrating the operation of the light source module in accordance with an exemplary embodiment.

FIG. 8 is a flowchart illustrating the operation of the light source module in accordance with an exemplary embodiment.

Referring to FIG. 8, in step S100 an average gray level of each respective display regions A is calculated using converted image signals TIS provided to the display regions A corresponding to the respective light source blocks B. In step S110, an inherent brightness value of each corresponding display region A is calculated using the average gray levels. The average gray level represents the average of the gray level values of the portion of the converted image signals TIS provided to each of the display regions A. The inherent brightness value represents the brightness of the image according to the average gray level. At this point, the brightness value corresponding to the average gray level within a reference gray level range is calculated as the inherent brightness value. Furthermore, the converted image signals TIS applied from the outside before calculation of the average gray level may be grouped according to the display regions A of the LCD panel 1100. In step S120, interference brightness values of the display regions A are calculated using the previously calculated inherent brightnesses and a PSF filter. In step S130, a threshold gray level is set using the interference brightness values. In step S140, the average gray level value (average gray level) is compared with the threshold gray level value. Thus, it is determined if the average gray level is greater than the threshold gray level value. In step S150, when the average gray level is greater than or equal to the threshold gray level value, the maximum output brightness value (e.g., 100) is output as a dimming control signal DIS to the corresponding light source block B. In step S160, when the average gray level is less than the threshold gray level value, a final brightness value corresponding to a sum of the inherent brightness value and the interference brightness value is output as the dimming control signal DIS to the corresponding light source block B. The light source block B receiving the dimming control signal DIS emits light with brightness corresponding to the dimming control signal.

The present invention is not limited to the above exemplary embodiment. When the average gray level given after determining the threshold gray level is less than the threshold gray level, the inherent brightness value corresponding to the preset average gray level can be changed. A light source module in accordance with another exemplary embodiment will be described with reference to the accompanying drawings. Aspects of the description redundant of the above-described exemplary embodiment will be omitted. The technology of the exemplary embodiment of FIG. 9 can also be applied to the above-described exemplary embodiment.

Figure 9:
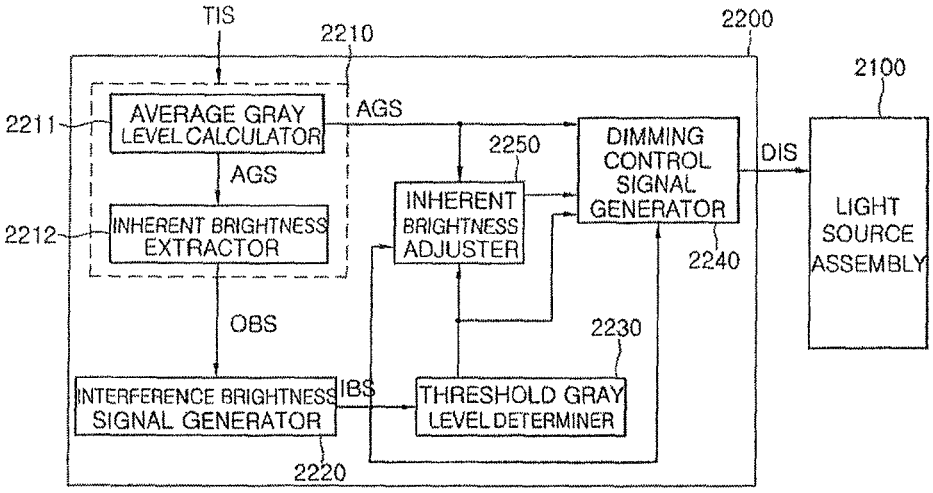
FIG. 9 is a block diagram of an alternative implementation of the dimming controller 2200 of a light source module shown in FIG. 1.
Figure 10:
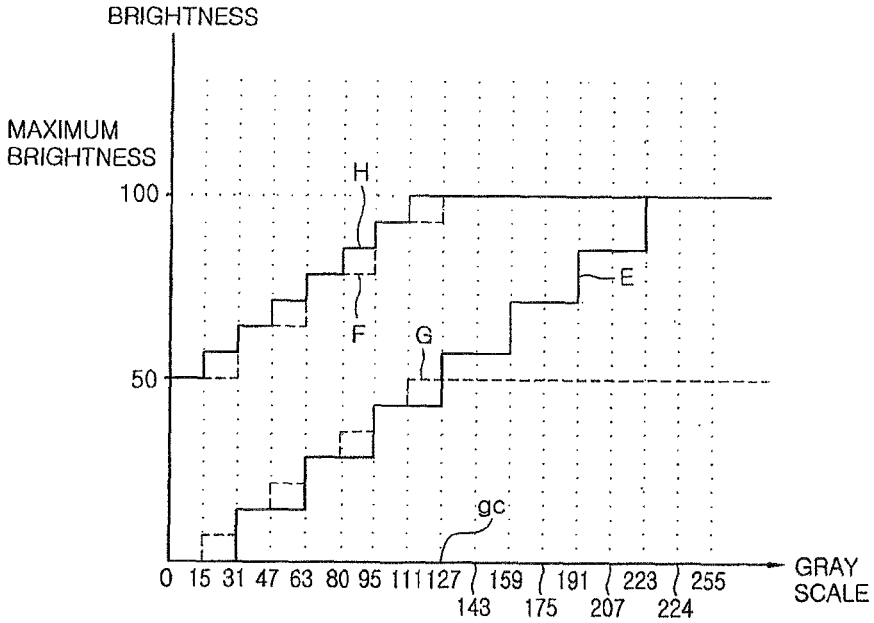
FIG. 10 is a graph comparing brightness of a backlight block with gray levels of an image signal of the block in accordance with another exemplary embodiment.

FIG. 9 is a block diagram of a light source module in accordance with another exemplary embodiment of the invention. FIG. 10 is a graph illustrating brightness with respect to gray levels of an image signal in accordance with another exemplary embodiment. FIG. 11 illustrates a uniform lookup table in accordance with another exemplary embodiment. FIG. 12 illustrates a variable lookup table in accordance with another exemplary embodiment.

Referring to FIGS. 9 through 12, the light source module in accordance with another exemplary embodiment includes a light source assembly 2100 and a dimming control unit 2200.

The dimming control unit 2200 calculates an inherent brightness caused by the average gray level of each display region A and an interference brightness caused by average gray levels of the adjacent display regions A adjacent to each corresponding display region A, and determines a threshold gray level according to the interference brightness. When the average gray level of a corresponding display region A is equal to or greater than the threshold gray level, the maximum brightness is output as the dimming control signal DIS for the corresponding display region A. When the average gray level of the corresponding display region A is less than the threshold gray level, the inherent brightness is changed. Thereafter, the sum of the changed inherent brightness and the interference brightness is output as the dimming control signal DIS for the corresponding display region A.

The dimming control unit 2200 includes an inherent brightness signal generator 2210, an interference brightness signal generator 2220, a threshold gray level determiner 2230, a dimming control signal generator 2240, and an inherent brightness adjuster 2250.

The inherent brightness signal generator 2210 includes an average gray level calculator 2211 configured to output an average gray level signal AGS corresponding to the average gray level by using the portion of the converted image signal TIS provided to each display region A, and an inherent brightness extractor 2212 configured to extract an inherent brightness value by using the average gray level and to output the extracted inherent brightness value as the inherent brightness signal.

As shown in the graph in FIG. 10, plotting average gray level against output brightness, a plurality of gray levels correspond to each one output brightness. Therefore, as illustrated in FIG. 11, the inherent brightness extractor 2212 may include a uniform lookup table storing uniform gray level groups each including an equal number plurality of gray levels, and brightness values corresponding to each of the uniform gray level groups. In FIG. 11, 32 gray levels are included in each one uniform gray level group, and the step difference between the brightness values of adjacent uniform gray level groups is about 14. However, the present invention is not limited to this exemplary embodiment. The number of gray levels within each one uniform gray level group may be more than 2, and the step difference between the brightness values may be greater than or less than 14. Moreover, the number of gray levels included in the gray level groups may be different in each group, and may correspond to gamma values for particular LCD molecules employed in the LCD panel 1100. The step difference of the brightness values between the uniform gray level groups may be vary from one step to another.

Referring to stepping graph line E in FIG. 10 and the lookup table of FIG. 11, when the average gray level value calculated by the average gray level calculator is 63, the inherent brightness extractor 2212 outputs a value of 28 as the inherent brightness value. Even when the average gray level value is 80, the inherent brightness extractor 2212 outputs 28 as the inherent brightness value. When the average gray level value is 100, the inherent brightness extractor 2212 outputs 42 as the inherent brightness value. The inherent brightness extractor 2212 outputs the inherent brightness value as the inherent brightness signal OBS.

The interference brightness signal generator 2220 generates the interference brightness value of the corresponding display region A by using the inherent brightness signal OBS of the inherent brightness signal generator 2210 and the PSF filter. The threshold gray level determiner 2230 determines the threshold gray level by using the interference brightness value. Thus, as illustrated in FIG. 10, the threshold gray level is 127 when the interference brightness value is 50.

The inherent brightness adjuster 2250 varies the inherent brightness of the corresponding display region by using the threshold gray level, the average gray level of the corresponding display region A, and the interference brightness value. Thus, as illustrated in FIG. 12, the inherent brightness adjuster 2250 may include a variable lookup table storing variable gray level groups each having at least one gray level, and brightness values corresponding to the respective variable gray level groups. Thus, the inherent brightness adjuster 2250 divides gray levels lower than the threshold gray level into a plurality of variable gray level groups. The brightness values are set to the respective variable gray level groups. The number of gray levels within the variable gray level groups may be different from the number of gray levels within the uniform gray level group. In this exemplary embodiment, the number of gray levels within the variable gray level groups may be less than the number of gray levels within each one uniform gray level group. Thus, the number of gray levels within one uniform gray level group is 32 in the uniform lookup table of FIG. 11. The number of gray levels within the variable gray level groups except the last variable gray level group from the variable lookup table of FIG. 12 is 16. It is preferable that the maximum brightness value of the variable gray level group is the interference brightness value.

Even though the same average gray level value (average gray level) is applied to the inherent brightness adjuster 2250 and the inherent brightness extractor 2212, the inherent brightness value and the varied inherent brightness value may be different from each other. For example, when the average gray level is a gray level of 10, a gray level of 20, a gray level of 50, a gray level of 100, and a gray level of 200, the inherent brightness extractor 2212 outputs 0, 0, 14, 42 and 84 as the respective inherent brightness values. The inherent brightness adjuster 2250 outputs 0, 7, 21, 42 and 50 as the respective varied inherent brightness values. The varied inherent brightness values corresponding to the gray levels can be subdivided by adjusting the range of the variable gray level groups of the variable lookup table of the inherent brightness extractor 2212. Thus, in the previous exemplary embodiment, the inherent brightness values of the gray level of 10 and the gray level of 20 are both 0, but the varied inherent brightness values are 0 and 7, respectively. In this way, fine brightness dimming can be performed using the varied inherent brightness values obtained after subdividing the inherent brightness values.

The dimming control signal generator 2240 in accordance with this exemplary embodiment receives the average gray level signal AGS, the threshold gray level, the interference brightness value, and the varied inherent brightness value. Therefore, when the average gray level is higher than the threshold gray level, the dimming control signal generator 2240 generates the maximum brightness value as the dimming control signal DIS of a given light source block, without performing brightness dimming. When the average gray level is equal to or less than the threshold gray level, the sum of the varied inherent brightness value and the interference brightness value is output as the dimming control signal DIS. Thus, when using the inherent brightness value indicated by the stepping line E of FIG. 10, the number of the brightness values in the region where the average gray level is lower than the threshold gray level is five as indicated by a dotted line F of FIG. 10. However, when using the varied inherent brightness value indicated by a dotted line G of FIG. 10, the number of the brightness values in the region where the average gray level is lower than the threshold gray level is eight as indicated by a line H of FIG. 10. In this way, the fine brightness dimming can be performed by timewise subdividing (e.g., pulse width modulating) the dimming control signal DIS for the region where the average gray level is lower than the threshold gray level.

Although it has been described in this exemplary embodiment that the inherent brightness adjuster 2250 is implemented separate from the dimming control signal generator 2240, the present invention is not limited thereto. The inherent brightness adjuster may be combined into the dimming control signal generator 2240 as one component thereof.

The operation of the light source module 2000 in accordance with an exemplary embodiment will be described below.

Figure 13:
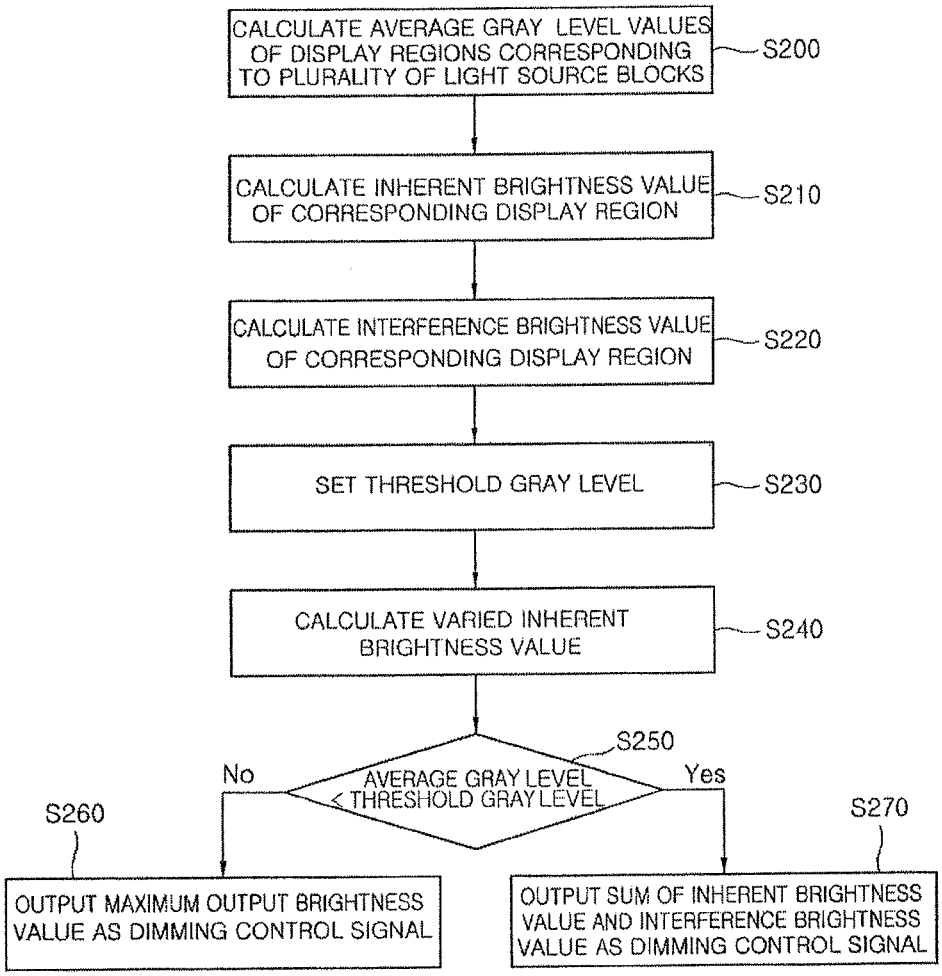
FIG. 13 is a flowchart illustrating the operation of the light source module in accordance with another exemplary embodiment.

FIG. 13 is a flowchart illustrating the operation of the light source module 2000 in accordance with another exemplary embodiment.

Referring to FIG. 13, in step S200, an average gray level value (average gray level) of the respective display regions A is calculated using converted image signals TIS provided to the display regions A corresponding to the respective light source blocks B. In step S210, an inherent brightness value of each display region A is calculated using its average gray level value (average gray level). The inherent brightness value is calculated using a uniform lookup table. In step S220, an interference brightness value of each of the corresponding display regions A is calculated using the inherent brightness and a PSF filter. In step S230, a threshold gray level is set using the interference brightness value. In step S240, a varied inherent brightness value is calculated with respect to the gray levels lower than the threshold gray level. The varied inherent brightness value is calculated using a variable lookup table in which the number of the gray levels within each variable gray level group is different depending upon the threshold gray level and the brightness value is different corresponding to the variable gray level group. In step S250, it is determined whether the average gray level is less than the threshold gray level value. In step S260, when the average gray level is greater than or equal to the threshold gray level value, the maximum output brightness value is output as the dimming control signal DIS to the corresponding light source block B. In step S270, when the average gray level is less than the threshold gray level value, a brightness value corresponding to the sum of the varied inherent brightness value and the interference brightness value is output as the dimming control signal DIS to the corresponding light source block B. The light source block B receiving the dimming control signal DIS emits light with brightness corresponding to the dimming control signal. Alternatively, after determining if the average gray level is less than the threshold gray level value, the varied inherent brightness value can be calculated only if the average gray level is less than the threshold gray level.

The present invention is not limited to the above exemplary embodiment. The interference gray level corresponding to the interference brightness value may be calculated after determining the threshold gray level. The brightness dimming can be performed in various ways by using the threshold gray level and the interference gray level. A light source module in accordance with yet another exemplary embodiment will be described with reference to the accompanying drawings. A description overlapping with the above-described exemplary embodiments will be omitted. The technology of the exemplary embodiment of FIGS. 14 and 15 can also be applied to the above-described exemplary embodiments.

Figure 14:
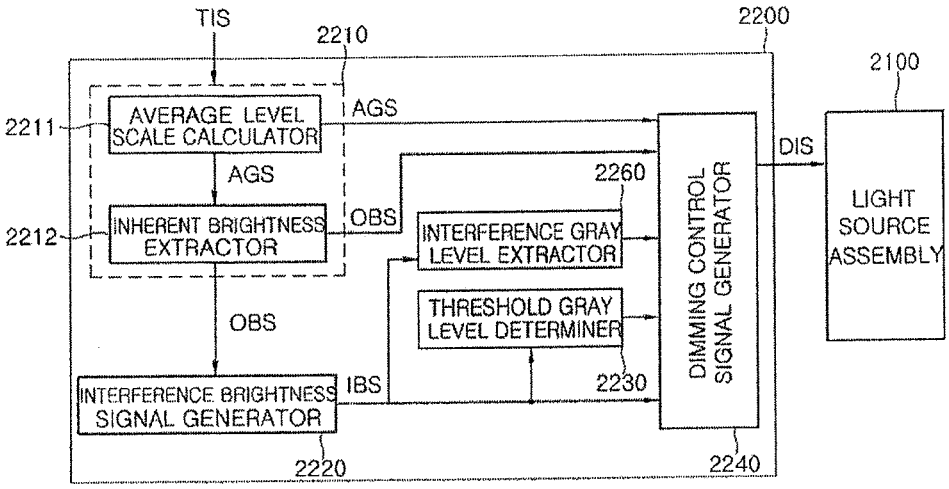
FIG. 14 is a block diagram of a light source module in accordance with yet another exemplary embodiment.
Figure 15:
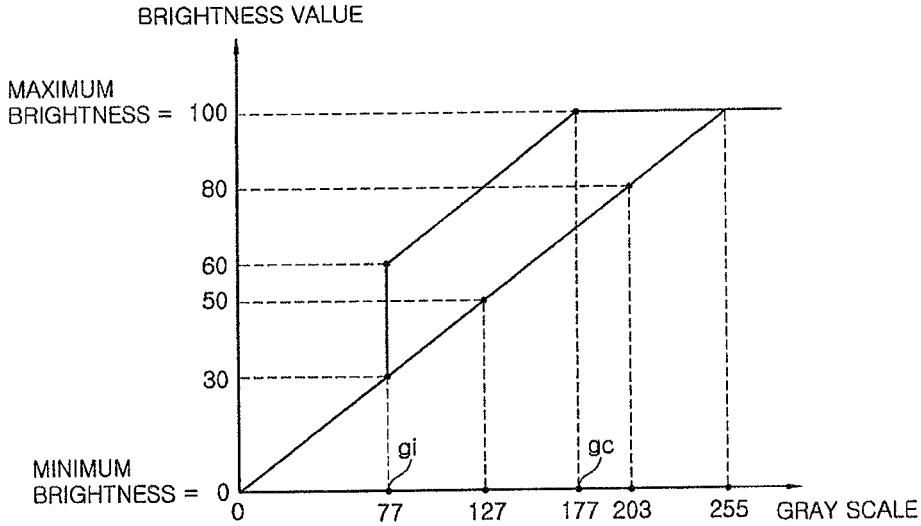
FIG. 15 is a graph comparing brightness of a backlight block with gray levels of an image signal of the block in accordance with yet another exemplary embodiment.

FIG. 14 is a block diagram of a light source module in accordance with yet another exemplary embodiment. FIG. 15 is a graph comparing brightness and gray levels of an image signal in accordance with yet another exemplary embodiment.

Referring to FIGS. 14 and 15, the light source module in accordance with yet another exemplary embodiment includes a light source assembly 2100 and a dimming control unit 2200.

The dimming control unit 2200 calculates an inherent brightness caused by an average gray level of each a display region A and an interference brightness caused by the average gray levels of display regions A adjacent to each of the corresponding display regions A, and determines an interference gray level according to the interference brightness. Thereafter, the dimming control unit 2200 determines a threshold gray level according to the interference brightness. When the average gray level of the corresponding display region A is between the interference gray level and the threshold gray level, the dimming control unit 2200 outputs the sum of the inherent brightness and the interference brightness as the dimming control signal DIS. When the average gray level of the corresponding display region A is less than or equal to the interference gray level, the dimming control signal generator 2200 outputs one of the minimum brightness, the inherent brightness, and the interference brightness as the dimming control signal DIS. When the average gray level of the corresponding display region A is greater than or equal to the threshold gray level, the dimming control signal generator 2200 outputs the maximum brightness as the dimming control signal DIS.

The dimming control unit 2200 includes an inherent brightness signal generator 2210, an interference brightness signal generator 2220, a threshold gray level determiner 2230, a dimming control signal generator 2240, and an interference gray level extractor 2260.

The inherent brightness signal generator 2210 includes an average gray level calculator 2211 configured to output an average gray level signal AGS corresponding to the average gray level value (average gray level) by using the portion of converted image signal TIS provided to each of the display regions A. The inherent brightness signal generator 2210 further includes an inherent brightness extractor 2212 configured to extract an inherent brightness value by using the average gray level and to output the extracted inherent brightness value as the inherent brightness signal.

The interference brightness signal generator 2220 generates the interference brightness value of the corresponding display region A by using the inherent brightness signal OBS of the inherent brightness signal generator 2210 and a PSF filter. The threshold gray level determiner 2230 determines the threshold gray level by using the interference brightness value. The interference gray level extractor 2260 extracts the interference gray level corresponding to the interference brightness value. For example, as illustrated in FIG. 15, when the interference brightness value is 30, the threshold gray level is 177 and the interference gray level is 77.

In this exemplary embodiment, the dimming control signal generator 2240 receives the average gray level, the threshold gray level, the interference gray level, the interference brightness value, and the inherent brightness value. When the average gray level is greater than the threshold gray level (gc) as indicated in FIG. 15, the dimming control signal generator 2240 outputs the maximum brightness value as the dimming control signal DIS. When the average gray level is between the threshold gray level (gc) and the interference gray level (gi), the dimming control signal generator 2240 outputs a brightness value corresponding to the sum of the inherent brightness value and the interference brightness value as the dimming control signal DIS. When the average gray level is less than the interference gray level (gi), the dimming control signal generator 2240 outputs the inherent brightness value as the dimming control signal DIS. In this exemplary embodiment, the brightness dimming is performed only in a region where the average gray level is less than the threshold gray level (gc). With a low average gray level less than the interference gray level (gi), the influence caused by the interference brightness can be excluded. In this way, the brightness reproduction in the low average gray level can be improved.

The interference gray level extractor 2260 can be integrated with the dimming control signal generator 2240. Additionally, the interference gray level extractor 2260 can be integrated with the threshold gray level determiner.

The operation of the light source module in accordance with yet another exemplary embodiment will be described below.

Figure 16:
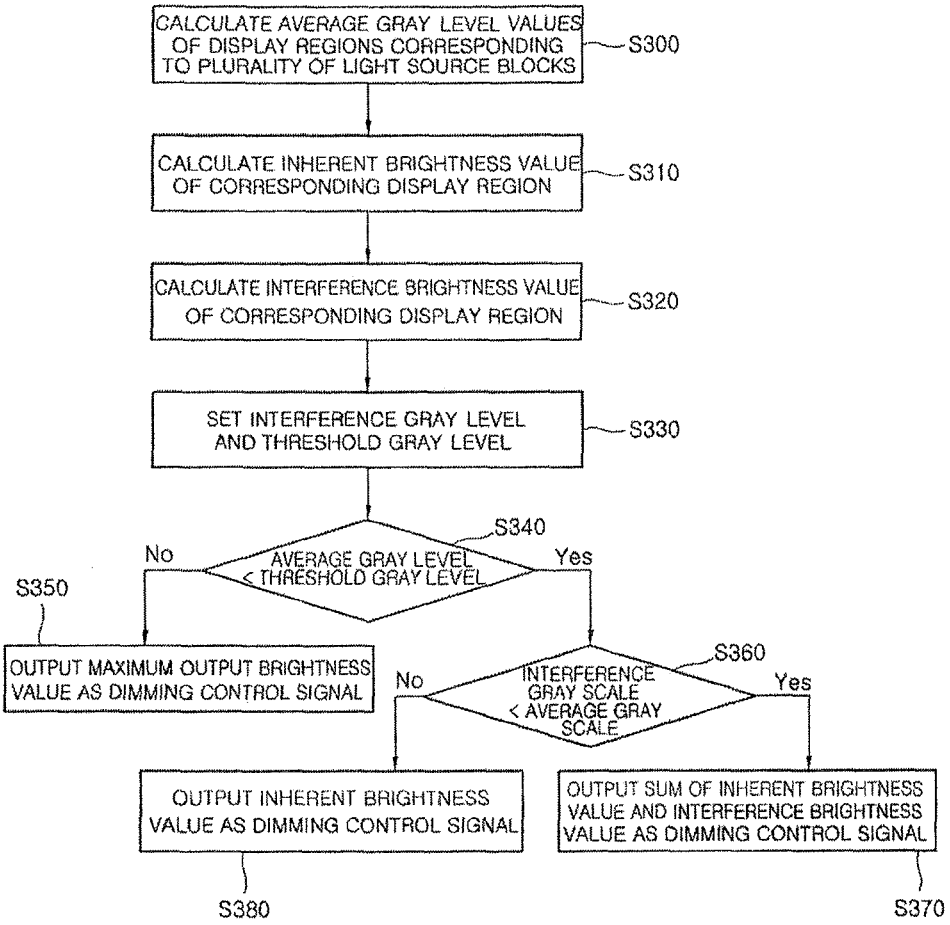
FIG. 16 is a flowchart illustrating the operation of the light source module in accordance with yet another exemplary embodiment.

FIG. 16 is a flowchart illustrating the operation of the light source module in accordance with yet another exemplary embodiment.

Referring to FIG. 16, in step S300, average gray level values (average gray levels) of each of the respective display regions A are calculated using converted image signals TIS provided to the display regions A corresponding to the respective light source blocks B. In step S310, inherent brightness values of each of the display regions A are calculated using the average gray level values (average gray level). In step S320, interference brightness values of the corresponding display regions A are calculated using the inherent brightness and a PSF filter. In step S330, an interference gray level and a threshold gray level are set using the interference brightness value. In step S340, it is determined whether the average gray level is less than the threshold gray level value. In step S350, when the average gray level is greater than or equal to the threshold gray level value, the maximum output brightness value is output as the dimming control signal DIS to the corresponding light source block B. In step S360, when the average gray level is less than the threshold gray level value, it is determined whether the average gray level is greater than the interference gray level value. In step S370, when the average gray level is greater than the interference gray level value, a brightness value corresponding to the sum of the inherent brightness value and the interference brightness value is output as the dimming control signal DIS to the corresponding light source block B. In step S380, when the average gray level is less than the interference gray level value, the inherent brightness value is output as the dimming control signal DIS to the corresponding light source block B. Thereafter, the light source block B receiving the dimming control signal DIS emits light with brightness corresponding to the dimming control signal.

As described above, the brightness spots between the display regions of the display panel can be reduced by performing the brightness dimming on the corresponding light source block with consideration of the interference brightness caused by the adjacent light source blocks.

Furthermore, by determining the threshold gray level according to the interference brightness caused by the adjacent display regions, the brightness dimming can be performed only in regions having gray levels higher than the threshold gray level or in regions having gray levels lower than the threshold gray levels. Thus, a sufficient relative contrast ratio can be obtained locally, and the brightness adjustment capability of the light source module can be maximized, thereby improving the visibility of displayed images.

Although a light source, a method for driving the light source, and a display device having the light source have been described with reference to the specific embodiments, the invention is not limited thereto. Therefore, it will be readily understood by those skilled in the art that various modifications and changes can be made thereto without departing from the spirit and scope of the present invention defined by the appended claims.

What is claimed is:

1. A display device, comprising:

a display panel comprising a plurality of display regions for sequentially displaying a plurality of images, wherein each of the display regions includes a plurality of pixels, and wherein each of the pixels displays one of a plurality of gray levels;

a light source assembly including a plurality of light source blocks respectively corresponding to the plurality of display regions, the light source assembly configured to dim the plurality of light source blocks according to dimming control signals based on a current image, wherein the dimming control signals comprise a first dimming control signal and a second dimming control signal; and a dimming control unit configured to calculate an average gray level for the plurality of pixels in each of the display regions with respect to the current image, an inherent brightness value of each of the display regions based upon the average gray level, and a threshold gray level of each of the display regions based upon the inherent brightness value, to separate the plurality of gray levels into a first gray level section and a second gray level section based on the threshold gray level, and to output the first dimming control signal to a first light source block of the plurality of light source blocks when the average gray level is within the first gray level section or to output the second dimming control signal to the first light source block when the average gray level is within the second gray level section, wherein the first dimming control signal enables the first light source block to emit light having a fixed brightness, and the second dimming control signal enables the first light source block to emit light having a variable brightness which varies according to the inherent brightness value.

2. The light source module of claim 1, wherein each of the light source blocks has a maximum brightness corresponding to a maximum brightness value, and wherein the first dimming control signal has the maximum brightness value, and the second dimming control signal has a brightness value less than the maximum brightness value.

3. The light source module of claim 1, wherein each of the light source blocks has a maximum brightness corresponding to a maximum brightness value, wherein the first dimming control signal has the maximum brightness value, and wherein the first dimming control signal is output when the average gray level is substantially equal to the threshold gray level.

4. The light source module of claim 1, wherein at least one gray level of the first gray level section is greater than the threshold gray level.

5. A display device, comprising:

a display panel comprising a plurality of display regions for sequentially displaying a plurality of images, wherein each of the display regions includes a plurality of pixels, and wherein each of the pixels displays one of a plurality of gray levels;

a light source assembly, including a plurality of light source blocks respectively corresponding to the plurality of display regions, the light source assembly configured to dim the plurality of light source blocks according to a dimming control signal based on a current image; and a dimming control unit configured to output the dimming control signal, wherein the dimming control unit comprises:

an inherent brightness signal generator configured to calculate an average gray level for the plurality of pixels in each of the display regions with respect to the current image and an inherent brightness value of each of the display regions using the determined average gray level;

an interference brightness signal generator configured to calculate an interference brightness value based upon inherent brightness values of display regions adjacent to each other;

a threshold gray level determiner configured to determine a threshold gray level of each of the display regions based upon the interference brightness value; and a dimming control signal generator configured to output one of a maximum brightness value or a brightness value less than the maximum brightness value as the dimming control signal, according to the threshold gray level and the average gray level.

6. The light source module of claim 5, wherein the threshold gray level corresponds to a brightness value that, when added to the interference brightness value, becomes the maximum brightness value.

7. The light source module of claim 5, wherein the inherent brightness signal generator comprises:

an average gray level calculator configured to calculate the average gray level by using image signals of the current image, wherein the image signals are applied to the display regions, respectively; and an inherent brightness extractor configured to extract a brightness value corresponding to the average gray level as the inherent brightness value.

8. The light source module of claim 7, wherein the inherent brightness extractor comprises a uniform lookup table configured to store a plurality of uniform gray level groups each including at least one gray level, and a plurality of brightness values corresponding to the uniform gray level groups, respectively.

9. The light source module of claim 8, further comprising an inherent brightness adjuster including a variable lookup table configured to store a plurality of variable brightness values corresponding to a plurality of variable gray level groups each including gray levels less than the threshold gray level and configured to extract brightness values corresponding to the average gray level as a varied inherent brightness value by using the variable lookup table, wherein the number of the gray levels within a variable gray level group is less than the number of the gray levels within a uniform gray level group.

10. The light source module of claim 9, wherein a maximum variable brightness value of the variable lookup table is the interference brightness value.

11. The light source module of claim 9, wherein the dimming control signal generator is configured to output a brightness value corresponding to a sum of the varied brightness value and the interference brightness value as the dimming control signal when the average gray level is less than the threshold gray level and is configured to output the maximum brightness value as the dimming control signal when the average gray level is greater than or substantially equal to the threshold gray level.

12. The light source module of claim 5, wherein the interference brightness value is calculated using a point spread function (PSF) filter, and wherein the PSF filter has a matrix form with a plurality of weight values, and wherein a center value of the matrix form is in a range of about 0.1 to about 1, and values around the center value of the matrix form decrease in the form of a Gaussian function.

13. The light source module of claim 12, wherein a center of the PSF filter is arranged to correspond to a center display region, and wherein the interference brightness values are obtained by multiplying the weight values, except for the center value of the matrix form, by the inherent brightness values of the display regions adjacent to each other and by summing the multiplied values.

14. The light source module of claim 5, wherein the dimming control signal generator is configured to output a brightness value corresponding to a sum of the inherent brightness value and the interference brightness value as the dimming control signal when the average gray level is less than the threshold gray level and is configured to output the maximum brightness value as the dimming control signal when the average gray level is less than the threshold gray level.

15. The light source module of claim 5, further comprising an interference gray level extractor configured to generate an interference gray level based upon the interference brightness value.

16. The light source module of claim 15, wherein the dimming control signal generator is configured to output the maximum brightness value as the dimming control signal when the average gray level is greater than or substantially equal to the threshold gray level, to output a brightness value corresponding to the sum of the inherent brightness value and the interference brightness value as the dimming control signal when the average gray level is less than the threshold gray level and greater than or substantially equal to the interference gray level, and to output one of the inherent brightness value or a minimum brightness value as the dimming control signal when the average gray level is less than the interference gray level.

17. A method for driving a light source module for sequentially displaying a plurality of images, the method comprising:

calculating an average gray level of pixels of a current image in each of a plurality of display regions respectively corresponding to a plurality of light source blocks based upon image signals of the current image applied to the pixels in the display regions, wherein each pixel displays one of a plurality of gray levels based upon an applied image signal of the current image;

calculating an inherent brightness value of each of the display regions by using the calculated average gray levels of the plurality of pixels of the current image in the display regions;

calculating a threshold gray level according to inherent brightness values of a predetermined display region and of display regions adjacent to the predetermined display regions; and sectioning the plurality of gray levels into a first gray level section and a second gray level section based on the threshold gray level; and enabling a light source block corresponding to the predetermined display region to emit light having a brightness value based upon an inherent brightness value when an average gray level is within the first gray level section, or enabling the light source block corresponding to the predetermined display region to emit light with a maximum brightness value when an average gray level is within the second gray level section.

18. The method of claim 17, further comprising:

calculating an interference brightness value of the predetermined display region by using an inherent brightness value of each of display regions adjacent to each other and a point spread function (PSF) filter; and determining, as the threshold gray level, a gray level corresponding to a brightness value that, when added to the interference brightness value, becomes the maximum brightness value.

19. The method of claim 18, wherein a brightness value of the emitted light based upon the inherent brightness value is obtained by summing the interference brightness value and the inherent brightness value.

20. The method of claim 18, further comprising generating an interference gray level by using the interference brightness value, wherein emitting the light by the light source block comprises:

enabling the light source block to emit light with the inherent brightness value or minimum brightness value when the average gray level is within the first gray level section and is less than the interference gray level; and enabling the light source block to emit light with brightness value varying according to the inherent brightness value when the average gray level is greater than the interference gray level and less than the threshold gray level.

21. The method of claim 17, further comprising extracting a brightness value corresponding to the average gray level as a brightness value of a light source block by using a variable lookup table, the variable lookup table configured to store a plurality of variable gray level groups each including gray levels less than the threshold gray level and a plurality of variable brightness values corresponding to the variable gray level groups, respectively, wherein the inherent brightness value is calculated by using a uniform lookup table, the uniform lookup table configured to store a plurality of uniform gray level groups each including at least one gray level and a plurality of brightness values corresponding to the uniform gray level groups, respectively, wherein the number of the gray levels within each of the variable gray level groups is less than the number of the gray levels within each of the uniform gray level groups.

22. The method of claim 21, wherein a brightness value of the emitted light based upon the inherent brightness value is obtained by summing the interference brightness value and the inherent brightness value.

23. A display device, comprising:

a display panel having an image display panel, the image display panel divided into N display regions, wherein each of the display regions includes a plurality of pixels, wherein each of the pixels displays one of a plurality of gray levels, wherein N is a natural number greater than one;

a light source assembly including N light source blocks respectively corresponding to the N display regions, wherein each of the light source blocks is configured to have an output brightness that dims according to N dimming control signals, wherein the N dimming control signals comprise a first dimming control signal and a second dimming control signal; and a dimming control unit configured to calculate an average gray level and an inherent brightness value of the pixels in each of the N display regions, and a threshold gray level of each of the N display regions based upon the inherent brightness value of pixels;

separate the plurality of gray levels into a first gray level section and a second gray level section based on the threshold gray level; and for each of the N light source block, output a first dimming control signal when an average gray level of a display region is within the first gray level section and output a second dimming control signal when an average gray level of a display region is within the second gray level section, wherein the first dimming control signal enables a light source block to emit light having a fixed brightness, and the second dimming control signal enables a light source block to emit light having a variable brightness which varies according to the inherent brightness value.

24. The display device of claim 23, wherein the dimming control unit is included in an integrated circuit (IC) chip, wherein the IC chip is mounted on the light source assembly, on the display panel, or on a substrate electrically connected to the light source assembly.

* * * * *